United States Patent [19]

Mashiko et al.

[11] Patent Number: 4,486,513

[45] Date of Patent: Dec. 4, 1984

[54] PROCESS FOR PRODUCING RHODIUM-PLATED ARTICLE WITH BLACK COLOR AND WEAR RESISTANCE

[75] Inventors: Masayoshi Mashiko, Tokyo; Keijiro Suzuki, Hitachi, both of Japan

[73] Assignees: Nippon Mining Co., Ltd.; Nippon Metal Plating Co., Ltd., both of Tokyo, Japan

[21] Appl. No.: 361,551

[22] Filed: Mar. 24, 1982

[30] Foreign Application Priority Data

Mar. 30, 1981 [JP] Japan ..... 56-045522

[51] Int. Cl.[3] ..... C25D 11/34

[52] U.S. Cl. ..... 428/670; 204/38 A; 204/42; 204/56 R; 204/140

[58] Field of Search ..... 204/38 A, 42, 56 R, 204/58, 140; 428/670

[56] References Cited

U.S. PATENT DOCUMENTS

| | | | |
|---|---|---|---|
| 2,738,897 | 3/1956 | Russell et al. | 204/42 X |
| 3,290,233 | 12/1966 | Hay et al. | 204/38 |
| 3,763,002 | 10/1973 | Skomoroski et al. | 204/37 |
| 4,052,271 | 10/1977 | Beer | 204/38 A |

FOREIGN PATENT DOCUMENTS

| | | | |
|---|---|---|---|
| 52-24131 | 2/1977 | Japan | 204/47 |
| 53-1648 | 1/1978 | Japan | 204/42 |
| 446393 | 4/1936 | United Kingdom | 204/47 |

*Primary Examiner*—G. L. Kaplan
*Assistant Examiner*—William T. Leader
*Attorney, Agent, or Firm*—Burns, Doane, Swecker & Mathis

[57] ABSTRACT

A process for improving the wear resistance and enhancing the black color of a black rhodium plated article which comprises subjecting the article to anodic electrolysis.

8 Claims, No Drawings

PROCESS FOR PRODUCING RHODIUM-PLATED ARTICLE WITH BLACK COLOR AND WEAR RESISTANCE

BACKGROUND

The present invention relates to a novel process for making a rhodium-plated article developing black color and having an improved wear-resistance.

All the colors of the platings which are practically obtainable through known rhodium-plating baths are white, the known rhodium baths comprising various rhodium salts, e.g., sulfate or phosphate.

Rhodium-plating has been generally employed for use in electric contacts, lead frames and ornamental articles due to its good hardness, wear resistance, corrosion or erosion resistance and stability in the contact resistance. Furthermore, it has been desired to develop rhodium plating with different colors besides white, as it will enhance the practical value of the rhodium plating.

On the other hand, known manners for black plating or black coloring such as black chrome plating, black nickel plating, blackening with copper carbonate all encounter difficulties in obtaining gloss, some of them yielding clouding, that is to say, these all being less valuable in the ornamental effect. There have been further problems in the manufacturing process, wherein they showed bad reproducibility in operation conditions, difficulties in mass production or the like. Thus there has been much to be desired in the prior art and it has long been desired to develop black color plating of noble metal in the ornamental article industries.

SUMMARY OF THE INVENTION

A rhodium-plating process developing black color has been developed by colleagues of the applicants and filed on Sept. 23, 1981, Ser. No. 304,939, which application was assigned to the same assignee as that of the present application. The wear resistance and adhesion is still desired to be improved for extending practical use thereof.

Accordingly, an object of the present invention is to provide a process for improving the wear resistance of the rhodium plating with black color.

Another object of the present invention is to provide a process for making a rhodium-plated article with black color as well as mirror-like gloss.

A further object of the present invention is to provide a process for improvement or enhancement in the black color.

Still further objects of the invention will become apparent from the disclosure hereinbelow.

First of all, the entire disclosure of the copending U.S. patent application Ser. No. 304,939, T. Kinase et al. filed on Sept. 23, 1981 is incorporated herein by reference with respect to rhodium-plating on desired articles which application serves as a starting point for the present invention. The disclosure of Kinase et al is summarized as follows:

Rhodium-plating with black color and mirror-like gloss is obtainable through a normal plating manner in an acid rhodium-plating bath including an additive consisting of at least one selected from the group consisting of organocarboxylic acid, aromatic sulfonic acid or salts of these, amine, gelatine, butynediol and hypophosphite, the resultant rhodium-plating providing good corrosion or erosion resistance. This rhodium-plating provides a plating suitable for ornamental articles, particularly glasses, watches, accessories, cosmetics or dinner wares. Based on such disclosure the present inventors have further investigated and completed the present invention. Now, it has been revealed that further development of the present invention is accomplished through applying anodic electrolysis treatment (or so-called anodic treatment) to the rhodium-plated article with the black color resulting in the improvement in the wear resistance and adhesion as well as the blackness.

The rhodium-plated articles thus treated in the present invention are suitable for, e.g., frames of glasses, cases, faces and bands of watches, necktie pins, lighters, necklaces, rings, compacts, caps for lip sticks and the like. The articles of the present invention may be utilized not only in the ornamental purpose but in various fields which require such a good plated coating.

The present invention will be described hereinbelow with reference to preferred embodiments which will, however, serve to better illustrate the invention and not as a limitation thereof. Modifications may be done without departing from the gist of the present invention.

DETAILED DESCRIPTION OF THE INVENTION

Plated articles with the black color to be treated through the anodic treatment are those which were rhodium-plated on the surface and have the black color as aforementioned. Such rhodium-plated articles with the black color are used as starting articles for the inventive anodic treatment.

General manners for the anodic treatment, known per se, may be employed in the anodic treatment of the invention. Namely, the anodic treatment is effected in a bath comprising electrolyte, additives and/or the like.

Electrolyte applicable to the anodic treatment encompasses organic and inorganic substances either alone or in combination. The pH value and the temperature of the bath for anodic treatment may be adopted according to such conditions that are applicable in the conventional plating or electrolytic treatment.

The electrolyte or additives for such purpose are as follows: organic acid such as citric acid, glutamic acid, tartaric acid, acetic acid, stearic acid, lactic acid, succinic acid, sulfamic acid, or salts thereof with sodium, potassium or ammonium; inorganic acid such as pyrophosphoric acid, phosphoric acid, carbonic acid, cyanic acid, boric acid, silicic acid, or salts of these inorganic acids; methyl alcohol, ethyl alcohol, ethylene glycol, benzylamine, cyclohexane, EDTA, sodium saccharinate, polyacrylamide, or polyethylene imine.

Upon the anodic treatment, an insoluble cathode of known nature, e.g., platinum, titanium-rhodium alloy, titanium-platinum alloy, stainless steel, carbon or the like may be employed.

The anodic treatment of the present invention is successfully effected, e.g., under the following conditions: a bath temperature at 30°-60° C., a concentration of the electrolyte at 10-100 g/l, a current density of 0.1-20 A/dm$^2$, and a treating period of 3-60 minutes. However, deviation from these conditions may be done optionally.

The composition of the bath generally affects the bath potential, anode current density and treating time, which makes it necessary to chose each optimal condition for each treating bath, thus such treatment conditions cannot be unconditionally or generally determined without specifying the bath composition. The reason being that the oxygen overvoltage for each electrolyte is different.

For instance, provided that a bath comprising 50 g/l sodium citrate is used, an anode current density of not less than 0.1 A/dm$^2$ is sufficient at a treatment time of three minutes, whereas a shorter treatment time suffices at a higher current density, or a longer treatment time is applied if the current density is small. The concentration of the electrolyte in the bath is so adopted that oxygen can be released at the anode, which concentration widely ranges, e.g., from a few g/l to that of the upper solubility limit.

Accordingly, the present invention also provides rhodium-plated articles having sufficient wear resistance for practical use and enhanced blackness through the anodic treatment of the rhodium-plated articles as aforementioned.

The starting rhodium-plated articles with the black color may be prepared as follows:

A plating bath as disclosed by Kinase et al comprises a normal acid rhodium plating bath comprising rhodium salt and free acid (known per se), and an additive consisting of at least one selected from the group consisting of organocarboxylic acid, aromatic sulfonic acid or salts of these, amine, gelatine, butynediol and hypophosphite (referred to "additive" hereinafter). This plating bath is used for plating treatment of the articles resulting in rhodium-plating articles with desired properties.

Normally, the plating bath comprising three ingredients of rhodium salt, free acid and the additive such as organocarboxylic acid hereinabove mentioned will be sufficient for accomplishing the purpose of the present invention.

Rhodium salts which are normally used in the conventional rhodium plating, e.g., sulfate, phosphate, sulfamic acid and the like are employed as the rhodium salt for the plating bath.

The rhodium salt concentration in the bath ranges within a conventional, normal concentration, i.e., from 0.1 g/l to 20 g/l. At a concentration below 0.1 g/l the speed of electrodeposition will be undesirably reduced. At a concentration exceeding 20 g/l the expensive rhodium would be used without effective utilization.

The free acid encompasses acids which are normally used in the acid plating bath, such as sulfuric acid, phosphoric acid, sulfamic acid and the like.

Among such additives, organocarboxylic acid and aromatic sulfonic acid are used in either a free acid form or a salt form, only one of these being sufficient, however, two or more being applicable. The terms organocarboxylic acid or aromatic sulfonic acid denote also their salts hereinafter. Such salts encompass sodium or potassium salt.

The concentration of organocarboxylic acid and/or aromatic sulfonic acid should be determined relating to the concentration of rhodium, and, however, be not less than 0.01 g/l, a lower concentration of which would deleteriously affect color development. These additives may be added to the bath up to a solubility limit in the bath, however, used at a concentration which is practically sufficient.

Organocarboxylic acid of the invention encompasses acetic acid and benzoic acid which have only one carboxylic group and no other functional group, phthalic acid and thiomalic acid which have two carboxylic groups, and salts of each.

The concentration of aromatic sulfonic acid in the bath approximates that of organocarboxylic acid. Aromatic sulfonic acid encompasses benzenesulfonic acid, nitrobenzenesulfonic acid, phenolsulfonic acid, metanilic acid or the like and salts of these acids.

The additives to the bath further encompasses amine, gelatine and butynediol. Amine encompass ethylenediamine, triethanolamine, sulfuric hydroxylamine, diethylenetriamine or the like. One amine among those as the additive is sufficient, however two or more amines or amine(s) with other additives may be used.

The concentration of amine, gelatine and butynediol in the bath approximates that of organocarboxylic acid.

Hypophosphite as the additive encompasses alkali metal salts (sodium or potassium salt), alkaline earth metal salts (calcium or magnesium salt), other divalent metal salts (Co-, Ni-, Fe- or Mn-salt) and the like. Among those salts alkali metal salts or alkaline earth metal salts are preferred.

The concentration of hypophosphite as the additive in the bath approximately ranges from 0.5 to 10 g/l. A lower concentration less than 0.5 g/l does not develop sufficient effect, and that exceeding 10 g/l would cause cloudiness, i.e., to loose the gloss. This additive of hypophosphite requires slightly different conditions of plating with respect to pH, bath temperature or the like from the other additives aforementioned. For hypophosphite the pH should be below 2.5 as a higher pH would cause cracks or precipitation in the bath. An optimum temperature for hypophosphite approximately ranges from 20° to 45° C. A higher temperature exceeding 45° C. is not preferred as it enhances the possibility of the partial clouding. However, the current density at a conventional, normal range (e.g., approximately 0.5–5 A/dm$^2$) may be adopted.

The additives as hereinabove mentioned belong to essential ingredients of the bath according to the present invention, however, a further agent as a brightener may be added to the bath, i.e., 0.1–10 mg/l of nonionic surfactant may be used. Such nonionic surfactant encompasses that of the ether type, e.g., polyoxyethylenealkylether, polyoxyethylenealkylphenylether or the like, which are generally used as the brightener in the prior art, however, further serve to inhibit the plating from forming microcracks, partial clouding and to produce a uniform color tone.

Again turning to the additives other than hypophosphite, the pH value of the bath should not exceed 6. At a higher pH value than 6, rhodium in the bath will form hydroxide to form precipitation to disadvantage.

The color of the starting rhodium-plated coating or film relates to the thickness thereof, wherein a thicker coating will produce enhancing black color. Provided that benzoic acid is used as organocarboxylic acid, the plating of the thickness of 0.1 micron or more produces the black color. The thickness of 5 microns shows still the black color. Other organocarboxylic acid develops also the similar results in the color as well as the other additives aforementioned.

In the practical operation, it is also affected by plating conditions, whether the plating becomes black or blue, the plating conditions encompassing concentrations in the bath of the rhodium salt and the additive(s), bath temperature, current density, plating time, and the like. Such factors should be determined through a preparatory test plating while considering such factors. In the practical plating procedure, the control or choice of the color is preferably made mainly by changing the plating time under a predetermined bath condition.

The bath temperature and current density for plating procedure are adopted within the values as adopted in the conventional manner. A bath temperature of 10°-80° C. should be adopted. At a lower temperature less than 10° C., the current density will not sufficiently rise resulting in the low electrodeposition efficiency. At a temperature higher than 80° C., the disadvantage of violent vaporization of the bath will overcome the advantage of enhancement in the electrodeposition efficiency. The current density having close relation with the color tone should be 0.1-10 A/dm$^2$. A higher current density than 10 A/dm$^2$ will cause violent evaporation of gas at a cathode in the bath accompanied by a deteriorated color tone.

Materials for anode and cathode which are employed upon rhodium plating in the prior art may be used. The cathode may be selected from known material having a metallic surface such as brass, German silver (nickel silver), stainless steel or the like (however, iron, aluminium and zinc cannot be plated directly thereon). The cathode material further encompasses articles coated with strike (substrate coating), e.g., nickel strike or palladium-nickel strike. The cathode material encompasses also non-metallic articles coated with such substrate coating.

One of insoluble electrodes is sufficient for the anode, e.g., platinum electrode, titanium electrode coated with platinum or platinum-rhodium plating.

Other known manner generally applicable to the plating process may be optionally applied in the plating procedure.

The article thus obtainable by rhodium-plating and anodic treatment according to the present invention, has improved wear resistance sufficient for practical use, and adhesion, enhanced black color provided with mirror-like gloss on its surface, good corrosion or erosion resistance, and the hardness compatible with the conventional rhodium-plated articles.

Now, in the following, the present invention will be described in more detail by way of preferred embodiments thereof, which will not serve to limit the invention.

EXAMPLES 1-7

In a bath of pH 4.0 obtained by mixing rhodium sulfate (rhodium: 4 g/l), phthalic acid (2 g/l) and sulfuric acid were set a titanium anode plated with platinum and a cathode of a brass plate plated with a nickel strike. The brass plate was electroplated for ten minutes under conditions of a bath temperature of 30° C. and a current density of 0.5 A/dm$^2$.

The resultant plating film presented black color and mirror-like gloss provided with 0.3 micron thickness and good adhesion.

Thus obtained rhodium-plated brass plate was subjected to anodic treatment under conditions disclosed in Table 1.

The resultant sample pieces were tested with respect to the surface conditions such as the wear resistance, color difference, gloss and the like. The results are shown in Table 2.

The wear resistance was measured by rubbing the sample plate surface of 10 cm$^2$ on a backside of the cow leather under the application of 600 g load at a reciprocal movement speed of 1 cycle/second.

The color difference and gloss were measured according to the measuring method of mirror surface gloss, JIS Z 8741-1978 "gloss measurement method" by using a color difference meter of Nippon Denshoku Kogyo K.K. (type ND-5). The smaller is the value, the deeper or stronger blackness is represented.

As is shown in these results, the rhodium-plated article with the good wear-resistance and the much stronger blackness is obtainable according to these embodiments.

TABLE 1

| Example No. | electrolyte | concentration g/l | bath temperature °C. | bath potential V | current density DA A/dm$^2$ | treating time min. |
|---|---|---|---|---|---|---|
| 1 | Na—citrate | 50 | 50 | 6 | 6 | 3 |
| 2 | phosphoric acid | 10 | 40 | 3 | 4.5 | 5 |
| 3 | acetic acid | 50 | 30 | 10 | 0.5 | 45 |
| 4 | ammonia water (28%) | 30 ml/l | 20 | 10 | 0.3 | 30 |
| 5 | tartaric acid | 10 | | | | |
| | ammonium tartarate | 10 | 50 | 3 | 0.2 | 3 |
| 6 | Na—glutamate | 10 | 30 | 6 | 1.5 | 5 |
| | K—phthalate | 10 | | | | |
| 7 | triethanolamine | 25 ml/l | 30 | 6 | 2.5 | 5 |
| | Na—acetate | 50 | | | | |

TABLE 2

| Example No. | wear resistance: wear mg/1000 times | wear resistance: evaluation | surface conditions: color difference (L) | surface conditions: gloss (%) | Remarks |
|---|---|---|---|---|---|
| 1 | 0 | good | 18.9 | 409 | |
| 2 | 0.1 | " | 18.4 | 403 | |
| 3 | 0 | " | 18.0 | 397 | |
| 4 | 0 | " | 18.5 | 405 | |
| 5 | 0.2 | " | 19.1 | 410 | |
| 6 | 0 | " | 18.9 | 408 | |
| 7 | 0 | " | 18.3 | 402 | |
| R 8 | 5.6* | bad | 25.9 | 508 | Example 1 before anodic treatment *mg/200 times |
| R 9 | 0 | good | 34.4 | 976 | white rhodium plating |

EXAMPLE 8

In a bath of pH 4.0 obtained by mixing rhodium sulfate (rhodium: 4 g/l), benzoic acid (2 g/l) and sulfuric acid were set a titanium anode plated with platinum and a cathode of a stainless steel glasses frame plated with a palladium-nickel strike. The glasses frame was electroplated for 20 minutes under conditions of a bath temperature of 30° C. and a current density of 0.5 A/dm$^2$.

The resultant rhodium-plated frame presented black color and mirror-like gloss provided with 0.4$\mu$ plating thickness. Thus obtained rhodium-plates frame was further subjected to the same anodic treatment as in Example 1 resulting in good wear resistance.

EXAMPLES 9-15

Phthalic acid (2 g/l) in Example 1 was replaced with metanilic acid (1 g/l), under which condition rhodium plating was effected otherwise under the same condition as in Example 1. The resultant sample pieces were treated as in examples 1-7, resulting in the same good properties as in Examples 1-7.

EXAMPLE 16

Benzoic acid (2 g/l) in Example 8 was replaced with ethylene diamine (50 ml/l), under which condition otherwise the same conditions as in Example 8 rhodium plating was effected. The resultant sample pieces were treated as in Example 8, resulting in the same good properties as in Example 8.

EXAMPLE 17

The same rhodium-plated brass plate as used in Example 1 was subjected to anodic treatment under conditions of electrolyte composition, concentration and electrolysis conditions as shown in Table 3 otherwise in the same manner as in Example 1. The resultant pieces showed rhodium-plating films with the enhanced blackness and wear resistance.

TABLE 3

| electrolyte | concentration g/l | bath temperature °C. | current density A/dm$^2$ | bath potential V | treating time min. |
|---|---|---|---|---|---|
| K—cyanate | 50 | 50 | 9.0 | 6 | 3 |
| boric acid + Na—borate | 50 + 50 | 50 | 2.5 | 6 | 3 |
| ammonium citrate | 50 | 50 | 5.5 | 6 | 3 |
| citric acid | 50 | 50 | 1.0 | 6 | 3 |
| Phosphoric acid | 50 | 50 | 4.5 | 6 | 3 |
| acetic acid | 50 | 50 | 0.5 | 6 | 5 |
| Na—citrate | 100 | 25 | 0.02 ~ 0.5 | 1 ~ 5 | 1 ~ 10 |
| polyetheleneimine | 20 | 25 | 0.004 ~ 0.02 | 2 ~ 7.8 | 10 ~ 20 |

We claim:

1. A process for improving the wear resistance and enhancing the black color of a black rhodium-plated article which comprises subjecting a black rhodium-plated article to anodic electrolysis wherein the anodic electrolysis is carried out in a bath comprising one or more ingredients selected from the group consisting of:

organic acids selected from the group consisting of citric acid, glutamic acid, tartaric acid, acetic acid, stearic acid, lactic acid, succinic acid, sulfamic acid and salts thereof; inorganic acids selected from the group consisting of pyrophosphoric acid, phosphoric acid, carbonic acid, cyanic acid, boric acid, silicic acid and salts thereof, methyl alcohol, ethyl alcohol, ethylene glycol, benzylamine, cyclohexane, EDTA, sodium saccharinate, polyacrylamide, polyethylene imine, triethanolamine and ammonia water;

with a direct current of a current density of 0.004–20 A/dm$^2$ and a bath temperature for 20°–60° C. for 3–60 minutes.

2. The process as defined in claim 1, wherein the anodic electrolysis is carried out under a bath potential of 1–10 volts.

3. The process as defined in claim 1, wherein the current density is 0.004–0.5 A/dm$^2$.

4. The process is defined in claim 1, wherein the current density is 0.1–20 A/dm$^2$.

5. The process as defined in claim 1, wherein the temperature is 20° C.

6. The process as defined in claim 1, wherein the temperature is 30°–60° C.

7. The process as defined in claim 1, wherein the starting black rhodium-plated article is produced by a process for electroplating rhodium on an article which comprises: preparing a rhodium-plating bath comprising 0.1 to 20 g/l of a rhodium salt, a free acid which is selected from the group consisting of sulfuric acid, phosphoric acid, sulfamic acid and a combination thereof, and an additive consisting of at least one selected from the group consisting of an organocarboxylic acid, an aromatic sulfonic acid or salts of these, amine, gelatine, butynediol and hypophosphite, and electroplating an article in said rhodium-plating bath under such conditions that the rhodium-plating film develops black color.

8. A product obtained through the process as defined in claim 1 or claim 7.

* * * * *